US005897424A

United States Patent [19]

Evans et al.

[11] Patent Number: 5,897,424

[45] **Date of Patent: *Apr.27, 1999**

[54] RENEWABLE POLISHING LAP

[75] Inventors: Christopher James Evans, Gaithersburg, Md.; Robert Edson Parks, Tucson, Ariz.

[73] Assignee: The United States of America as represented by the Secretary of Commerce, Washington, D.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/500,404

[22] Filed: Jul. 10, 1995

[51] Int. Cl.[6] ..... B24B 11/00

[52] U.S. Cl. ..... 451/41; 451/63; 451/287; 451/285

[58] Field of Search ..... 451/41, 63, 285, 451/287, 288, 289, 538, 539, 550

[56] References Cited

U.S. PATENT DOCUMENTS

| | | | |
|---|---|---|---|
| 4,274,232 | 6/1981 | Wylde | 51/358 |
| 4,527,358 | 7/1985 | Day | 451/287 |
| 4,625,463 | 12/1986 | Sekiya | 51/216 R |
| 4,954,141 | 9/1990 | Takiyama et al. | 51/296 |
| 4,979,337 | 12/1990 | Duppstadt | 51/209 R |
| 4,980,995 | 1/1991 | Smith | 451/41 |
| 5,095,660 | 3/1992 | Dillon | 51/58 |
| 5,157,880 | 10/1992 | Rotenberg et al. | 51/358 |
| 5,205,083 | 4/1993 | Pettibone | 51/284 R |
| 5,329,734 | 7/1994 | Yu | 51/283 R |
| 5,403,228 | 4/1995 | Pasch | 451/259 |
| 5,503,590 | 4/1996 | Saitoh et al. | 451/41 |

*Primary Examiner*—Eileen P. Morgan
*Attorney, Agent, or Firm*—Millen White Zellano & Branigan

[57] ABSTRACT

A polishing lap which is resistant to attack from corrosive and reactive polishing media and which has a surface which is sufficiently resilient to provide good finishes without hindering dimensional controlling and accuracy of the texturing comprises: a lap substrate wherein the surface of the lap substrate has an overall shape and a localized texture; and a replaceable lap film applied to the lap substrate surface and which is deformed to correspond to the localized texture of the lap substrate surface. The polishing lap can be easily reconditioned if contaminated or easily modified for use with different abrasives and polishing media.

34 Claims, 4 Drawing Sheets

RENEWABLE POLISHING LAP

The invention relates to a lapping device for use in grinding, lapping and/or polishing substrates, such as semiconductor wafers, optical lenses, and computer hard disks, as well as methods of making same and methods of using same.

BACKGROUND OF THE INVENTION

A wide variety of laps are used in the polishing field to achieve smooth surfaces on a variety of substrates. When polishing, lapping or grinding, the surface of the lap is brought into contact with the surface of the substrate to be treated and relative movement is induced with respect to the substrate and the lap, resulting in smoothing of the substrate surface. A polishing media such as a particulate abrasive or an abrasive slurry is provided at the interface between the lap surface and the substrate to facilitate polishing. Typically, the polishing media is changed 2 to 4 times during the grinding and polishing procedure. Relative movement can be induced manually or mechanically. Examples of polishing laps are described by Wylde (U.S. Pat. No. 4,274,232), Takiyama et al. (U.S. Pat. No. 4,954,141), Duppstadt (U.S. Pat. No. 4,979,337), Smith (U.S. Pat. No. 4,980,995), Dillon (U.S. Pat. No. 5,095,660), Rotenberg et al. (U.S. Pat. No. 5,157,880), Pettibone (U.S. Pat. No. 5,205,083), Yu (U.S. Pat. No. 5,329,734) and Pasch (U.S. Pat. No. 5,403,228).

On a large scale, the lap surface has a shape corresponding to the desired general shape of the substrate to be treated. For example, the lap surface can be, in general, flat or, if the substrate is to have a concave surface, then the lap will have a corresponding convex surface. On a smaller scale, the lap surface is textured. Texturing facilitates dispersion of the polishing media over the lap surface as well as provides areas that can act as reservoirs for the polishing medium and for the material removed from the surface of the substrate being treated. The lap surface can be further provided with embedded abrasive particles to facilitate polishing.

The lap itself is often made of a hard material, such as cast iron or ceramic. These materials are accurately machined to achieve the desired overall shape, as well as the smaller scale texturing of the lap surface. During the polishing, lapping or grinding, the surface of the lap must be monitored to determine whether any changes occur. Changes in the surface conditions of the lap can induce imperfections in the substrate surface being, e.g., polished. As a result, if such changes occur, the lap must be replaced. Also, if the lap surface contains embedded abrasive particles, the abrasive size can change during the process, thereby requiring tedious lap cleaning and reconditioning procedures. Although good surface accuracy can generally be obtained using such hard laps, one is not often able to achieve the best surface finish. A further disadvantage associated with laps made of metal materials, such as cast iron, is that such laps may not possess adequate chemical resistance to the polishing media being employed which can be highly acidic, highly alkaline or in other ways reactive with the metal itself.

To eliminate some of the above-mentioned problems, it is known to use polishing cloths in conjunction with hard laps. In such cases, the hard laps are shaped as required to provide both the desired overall shape and texturing and then the lap surface is faced with a pad made of various materials, such as felt, velveteen or synthetic fabrics. While such laps can provide good surface finish when used with appropriate polishing media, there is a disadvantageous loss of dimensional control with respect to the shape of the substrate being treated.

Pitch laps having desired overall shape and local texture are also used in the polishing field. However, the production of such laps is a tedious process involving first melting the pitch and then pouring it onto an appropriate support substrate. Thereafter, once the pitch has cooled and hardened, the surface is cut to give a desired pattern, such as cross-hatching. The pitch lap is then pressed against a master surface or the substrate to be treated to generate the desired contour of the lap. While it is possible for such pitch laps to initially provide the desired finish and contour accuracy, maintaining the overall shape of the pitch lap can be difficult since pitch is a viscous fluid which continues to exhibit some degree of flow even at room temperature. A further disadvantage is that, if a pitch lap becomes contaminated by, for example, foreign particulate matter, or if its surface becomes damaged, a new lap must be made from scratch.

Chemically resistant polymeric laps are also known in the polishing art. In these laps, a polymeric material such as polytetrafluoroethylene (PTFE) is applied to a hard substrate and then treated to achieve the desired shape and texture. The elasticity of the polymeric layer can provide for the achievement of a good surface finish. However, the manufacturing of such laps is a time consuming procedure. Further, contamination of the polymeric layer by even a single large hard particle can render the lap useless and, thus, a new lap must be made again.

SUMMARY OF THE INVENTION

An object of the invention is to provide a polishing lap having the required combination of overall surface shape and localized texture which eliminates or ameliorates the disadvantages described above. In particular, an object of the invention is to provide a polishing lap which is resistant to attack from corrosive and reactive polishing media and which has a surface which is sufficiently resilient to provide good finishes without hindering the dimensional control and accuracy of the texturing.

A further object of the invention is to provide a polishing lap which can be easily reconditioned if contaminated or easily modified for use with different abrasives and polishing media.

Upon further study of the specification and appended claims, further objects and advantages of this invention will become apparent to those skilled in the art.

These objects are achieved in accordance with the invention by a polishing lap comprising:

- a lap substrate wherein the surface of the lap substrate has an overall shape and a localized texture; and
- a replaceable lap film applied to the lap substrate surface and which is deformed to correspond to the localized texture of the lap substrate surface.

In accordance with the invention, the lap substrate exhibits a localized texture of peaks and valleys. The lap substrate exhibits an overall shape, e.g., flat, concave or convex. In other words, the peaks or high points of the texture on the lap substrate are configured so as to provide the desired overall shape on a large scale. On the other hand, the valleys of the lap substrate texture provide regions for the retention of polishing media or for the accumulation of material removed from the substrate being polished. The appropriate degree of texturing depends on a number of variables including, for example, the substrate material characteristics, the abrasive used and the lapping film material.

The lap substrate surface is covered with a thin film which is deformed so as to correspond to the localized texturing of the lap substrate. As a result, the deformed film exhibits the same texture as that of the lap substrate. Thus, during the grinding, lapping or polishing procedure, it is the thin, replaceable, deformable film, rather than the lap substrate, that comes in contact with the polishing media and/or substrate being treated.

Numerous advantages result from the use of the thin, deformable film applied to the surface of the lap substrate. For example, since the film, rather than the surface of the lap substrate, contacts the polishing media and/or substrate to be treated, the lap substrate surface does not degrade or change during processing. Also, since the lap substrate does not contact the polishing media, one can use the lap with media that are chemically aggressive thereto. In addition, the thin film, e.g., polymeric film, provides sufficient resilience to achieve good finishes without being as soft as the fabric laps. The softness of fabric laps can generally cause a reduction in the accuracy of overall lap shape and/or its surface texture.

Further, at the end of a process step or if the film becomes contaminated, the user can easily remove the film and replace it in a very short period of time. Removal can be done manually or mechanically, for example, as part of an automated production system, e.g., silicon wafer production or in-process planarization. As a result, an entire production process, involving the use of several different abrasives, can be performed using a single lap. The film can be made to fit well to the shape of the lap surface without the occurrence of wrinkling or other distortions. Conversely, adhesive backed fabric lap materials are difficult to use and make fit well.

The textured lap substrate can be made from a wide variety of materials having sufficient rigidity to be used in grinding, lapping and/or polishing of selected substrates. For example, the lap substrate can be metal, ceramic, crystalline, glass-ceramic, glass, polymeric or a composite material. Suitable materials include foamed or porous silicon carbide, foamed or porous alumina (e.g., AmPorOx®), porous graphite, solid metals (e.g., aluminum, bronze, cast iron, steel, etc.) and porous metals (e.g., porous bronze), crystalline silicon, glass-ceramic (e.g., Macor®), fiber reinforced polymeric materials, metal matrix composites (e.g., silicon carbide in an aluminum matrix), whisker reinforced ceramics, etc.

Porous materials are preferred for the lap substrate. The solid network of the porous material provides the peaks of the texture which give the substrate its overall shape on the large scale while the pores provide the valleys of the texture. Typical porosities of foamed ceramics are, for example, about 10–65 ppi (ppi=pores per inch) (average number of pores intersected by a 1-inch long line drawn arbitrarily through the material). In this regard, suitable materials include porous compositions such as foamed alumina and porous bronze as well as, for example, metal grids and lattices. A texture or pattern can also be machined or etched into the surface of the lap substrate, for example, in the case of solid metals, glass, crystalline silicon, etc. As mentioned above, the overall shape of the lap substrate can vary, e.g., flat, concave or convex. In cases where the overall shape exhibits rapidly changing slopes, it is desirable to use lap films that are highly flexible to avoid the occurrence of wrinkles.

The lap film, in general, is sufficiently thin so as to exhibit the texture of the lap substrate surface when applied thereto and deformed. Further, the lap film preferably exhibits a uniform thickness so as to accurately correspond to the texture of the lap substrate surface. In addition, the lap film should be deformable so that it can be made to correspond to the texture of the lap substrate surface. Optionally, the lap film can itself exhibit a texture and/or can possess embedded abrasives. Preferably, the lap film is chemically resistant so that it can be used with a variety of polishing media. In addition, the lap film is preferably impermeable to prevent degradation and deterioration of the lap substrate surface from abrasives and chemically aggressive polishing media. The lap films can also be precut to seal around the edge of the lap substrate or can be made to seal around the edge of the lap substrate by application of the deforming force and/or application of a retention means.

Suitable materials for the lap film include polymer films, for example, films of polyethylene, polyester, polyvinylchloride, polymethylmethacrylate, polyether ether ketone, polytetrafluoroethylene, or their many derivatives. For example, suitable polymer films include commercial shrink-wraps which are deformable by the application of heat.

Other suitable materials for lap film include thin metal foils which are deformable over the textured lap substrate producing an appropriately textured lap. For example, the lap film can be an aluminum foil. Such a lap substrate/lap film can be used, for example, with a diamond abrasive to polish sapphire substrates. Other metal films, such as lead, zinc or tin can also be used.

Further, when the applied deformation force is a vacuum, any impermeable material having suitable thickness and polishing characteristics can be used as the lap film. For example, waxed paper can be used for polishing, e.g., softer crystal substrates such as those used in the electronics and infrared industries (NaCl, lithium niobate, frequency doubling crystals such as KDP, calcium fluoride, magnesium fluoride, etc.).

The thickness of the thin film can vary and will be dependent on the desired texture to be achieved and the degree of polishing desired. For example, suitable thicknesses include about 10–500 $\mu$m, for example, 20–75 $\mu$m.

As mentioned previously, the lap film is deformable so that the composite lap substrate/lap film will exhibit a surface corresponding to that of the textured lap substrate. In this regard, depending on the material used for the lap film, a variety of techniques can be used to deform the film, for example, application of vacuum, pressure, heat, solvents or other chemicals (e.g., pH treatments), electrostatic fields, magnetic fields, and/or mechanical force. In addition, to ensure retention of the resultant shape from deformation, one can optionally maintain the deformation force, e.g., vacuum, electrostatic or magnetic, during the polishing process. Also, an adhesive layer can be provided between the lap substrate surface and the lapping film so as to retain the deformed shape of the latter. The deformation can be permanent or temporary.

Upon deformation, the thin film rests on the peaks or high points of the texture and slumps into the low regions or valleys thereof. By deformation, the film conforms or partially conforms to the substrate texture. "Partially conforming" means that the thin film sits on the high spots, but does not extend into the lowest points of a textured surface.

In the case of vacuum deforming, the preferred deforming technique, a porous substrate is employed. Preferably, the back surface of the porous lap substrate is provided with appropriate patterns by machining or etching to uniformly apply the vacuum to the lap substrate.

By pulling a vacuum through the back of the substrate, the thin film applied to the lap substrate surface is deformed to correspond to the substrate texture. In a preferred embodiment, the vacuum is continuously applied during the polishing procedure to ensure that the film is maintained in its deformed state. A further advantage of this embodiment is that by monitoring the vacuum, film failure can be quickly detected by a sudden pressure increase. The polishing system could then be, for example, automatically shut down to avoid damaging the substrate being treated.

Conversely, pressurized gas can be used for deformation. In this case, the thin film is applied to the textured lap substrate, which may be porous or non-porous. The pressurized gas is then applied to the thin film surface forcing it to conform to the texture of the underlying lap substrate. For thermal deforming, the thin film must be capable of being softened or stretched by the application of heat. Heat can be applied by any method which does not damage the thin film. For example, the thin film can be a commercial shrink-wrap and hot air can be used to thermally soften the shrink-wrap.

If a conductive substrate is used, by appropriate selection of the thin film material, an electrostatic field can be applied to provide permanent plastic deformation for conforming the film to the lap substrate texture. For example, a charged film can be electrostatically deformed by bringing an electrode of appropriate electrical charge into close proximity to the lap film. In this case, the substrate is made of insulating material.

For magnetic films, for example, a thin iron or nickel film, or a composite film containing magnetic material (e.g., a polymer filled with magnetic particles), the film can be deformed by applying a magnetic field. Alternatively, mechanical means can be used for deforming. For example, an impression tool such as a die having a texture matched to that of the substrate can be used to "push down" the film over the textured substrate. An example of solvent softening is acetone treatment of an acetate thin film.

One skilled in the art can readily contemplate other techniques for deforming the thin film. Also, deforming procedures can be used in combination, for example, thermal or vacuum deformation in conjunction with mechanical deformation. Alternatively, appropriate solvents can be used to temporarily soften the film and positive gas pressure applied to simultaneously deform the film and evaporate off the solvents.

To facilitate maintaining the deformed structure, an adhesive layer can be employed between the lap substrate and the lap film. The adhesive layer can also aid in keeping the film on the lap substrate during polishing. Other means can be used to hold the film on the substrate. For example, the film can extend over the edge of the lap substrate and attach to the side thereof. Attachment can be achieved by the use of adhesives or by a restraining means such as a metal band or an O-ring. Also, continuous application of the deforming force (e.g., a vacuum) can be used to hold the film on the lap substrate.

The films can be simply removed manually or by mechanical force. Also, in the case where vacuum is used to provide deformation, after the polishing procedure, the vacuum line can be connected to a pressurized source to blow the film off.

For any lap device according to the invention, the optimum texture will depend on the abrasive being used, the pressure and speed used during polishing, and the size of the workpiece. Also, the resultant texture obtained will depend on the material properties of the film, and the method used to temporarily or permanently deform the film over the textured substrate (vacuum, air pressure, heat, chemical, etc.).

A wide array of polishing media can be used with the lap device according to the invention. Suitable polishing agents include: classical abrasives such as diamond, alumina, silicon carbide, boron carbide, bauxite, rouge, cerium oxide, etc.; and chemical-mechanical polishing media such as colloidal silica, colloidal alumina, chrome oxide, etc. Preferably, the size of the abrasive is smaller than half the thickness of the thin film.

In some applications, e.g., final polishing of silicon using colloidal silica, the chemo-mechanical polishing media is very chemically aggressive. To meet the adverse conditions, the lap device can be made completely of inert materials, for example, a textured lap substrate of foamed silicon carbide, a support ring and backing plate made of machined solid Teflon® (polytetrafluoroethylene, PTFE) and a lapping film of PTFE, e.g., 75 $\mu$m in thickness.

Texturing of the film at a different spatial scale from the lap texture can be useful in cases where the same lap substrate is to be used for several different polishing steps, wherein different textures are to be used for the different steps. Thus, for example, the thin film can be a ridged polymer film. Also, some polishing processes may be best with textures finer than can easily be obtained from a hard lap substrate, especially in cases where a vacuum is used to suck the film down into the substrate. In such cases, a textured film may be desirable.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
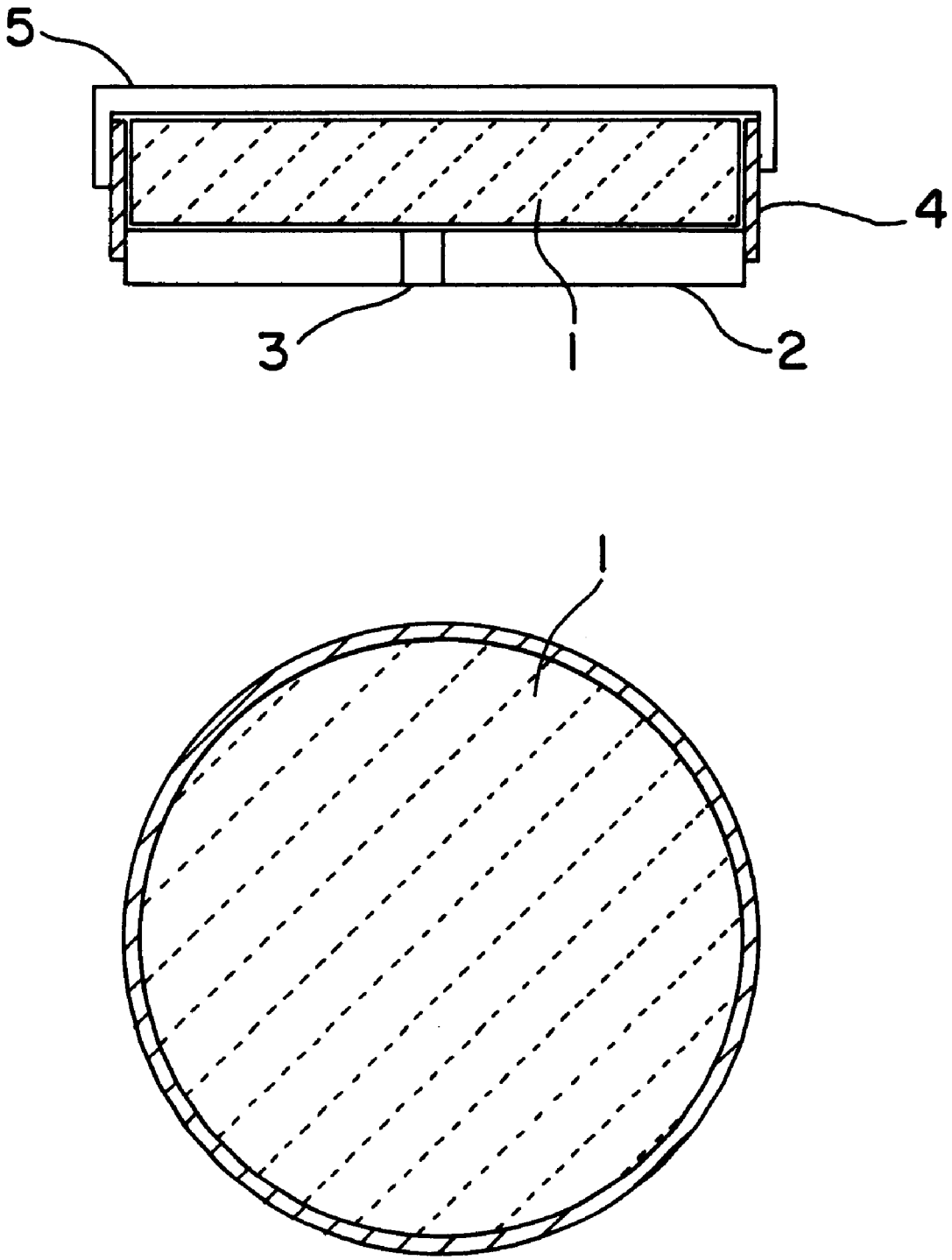
FIG. 1 illustrates an embodiment in accordance with the invention.

FIG. 1 shows a simple embodiment in accordance with the invention. A lap substrate 1 made of porous alumina (AmPorOx®) is positioned on top of a metal backing plate 2. The metal backing plate has a central hole 3 which can be connected to a vacuum supply such as a vacuum pump (not shown), whereby a vacuum can be pulled through the porous lap substrate. An edge seal 4, e.g., adhesive tape, is used to seal the side wall of the porous lap substrate. The edge seal can also be used to connect the lap substrate to the backing plate. An adhesive can also be used for connecting the lap substrate to the backing plate. A polymer film 5 is applied to the top textured surface of the lap substrate. Thereafter, a vacuum is drawn through the lap substrate via vacuum supply hole 3 and the film is deformed (not shown) so as to correspond to the texture of the top surface of the lap substrate.

Figure 2A:
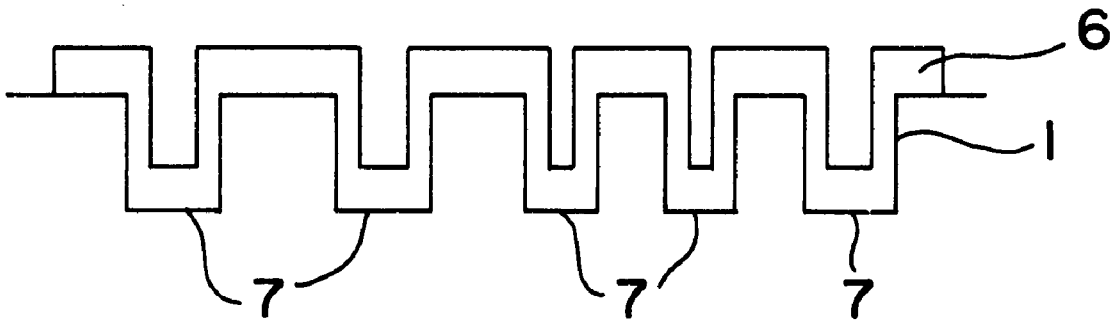
FIGS. 2A and 2B illustrate deformation of the thin film onto a textured substrate.
Figure 2B:
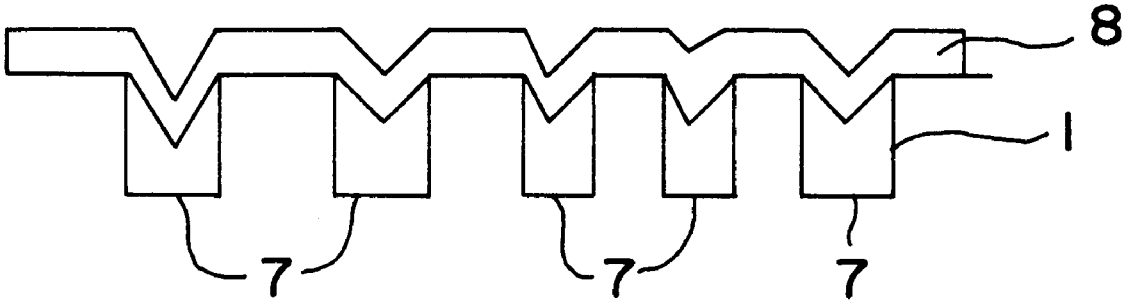

FIGS. 2A and 2B show the deformation of the thin film to correspond to the texture of the lap substrate 1. FIG. 2A illustrates a "conforming" thin film 6, wherein the film extends down into the lowest regions 7 of the texture. FIG. 2B, on the other hand, illustrates a partially conforming thin film 8 wherein the film extends only partially into the lowest regions 7 of the textured lap substrate.

Figure 3:
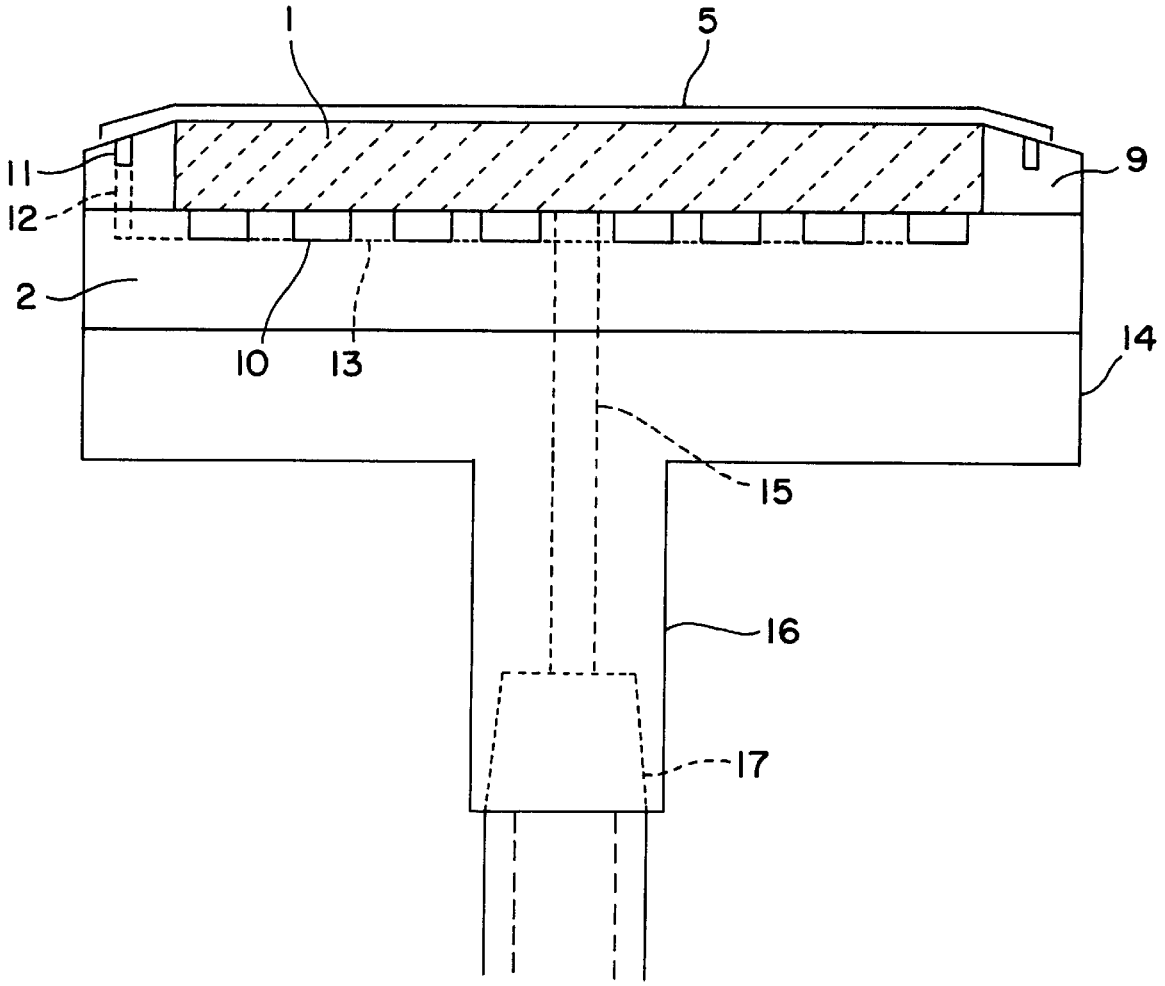
FIG. 3 illustrates a further embodiment in accordance with the invention.

In FIG. 3, a further embodiment in accordance with the invention is shown. In this embodiment, the textured lap substrate made of foamed ceramic is positioned within an edge support ring 9. The edge support ring 9 and lap substrate 1 are positioned on top of a vacuum back plate 2 provided with a central hole 3 for connection with a vacuum supply. In addition, the top surface of the vacuum backing plate 2 is provided with vacuum distribution rings 10 to provide a more even application of the vacuum to the back of the lap substrate. The edge support ring 9 is connected to the vacuum back plate 2 by suitable fastening means such as clamps or bolts. In addition, the edge support ring 9 is provided with an annular groove 11 in its sloped front face. One or more holes 12 are provided through the edge support ring 9 and are in fluid communication with a passageway 13 which connects the vacuum distribution rings 10. As a result, fluid communication is achieved from annular groove 11 through holes 12 and vacuum distribution rings 10 to vacuum supply hole 3. The vacuum back plate 2 is further connected to a cast iron support plate which is further provided with a central bore for fluid communication with the vacuum supply hole 3 of the vacuum back plate 2. In addition, the support plate 14 is provided with a connection means 16 whereby the device can be connected the se taper 17 at the end of the spindle of a grinding machine. The central bore 15 extends through connection means 16. Thus, via a hole through the center of the spindle, a vacuum can be pulled through the vacuum back plate 2, lap substrate 1 and the edge support ring 9.

A thin polymer film 5 is positioned on the top textured surface of the lap substrate 1. By the application of the vacuum, the polymer film 5 is deformed to conform to the texture of the lap substrate 1. In addition, the edge of the polymer film 5 is sealed to the edge support ring 9 via the application of the vacuum to the annular groove 11. The vacuum can be applied continuously throughout the polishing step or only during initial deformation of polymer film 5.

Figure 4:
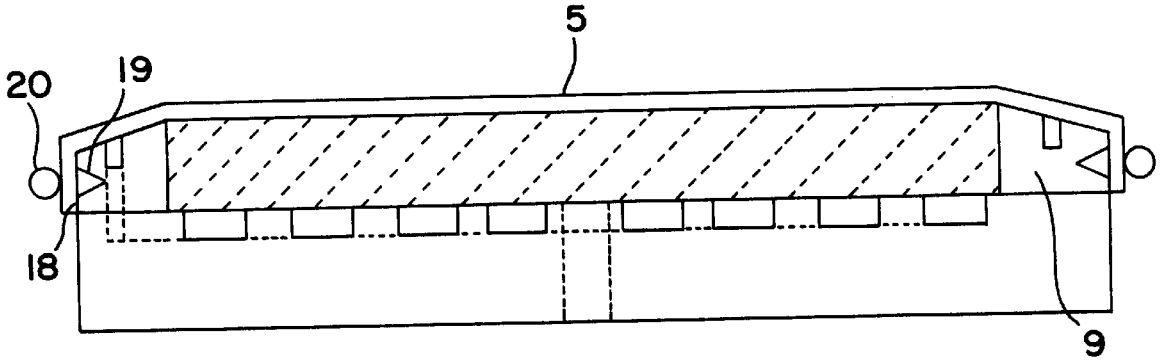
FIG. 4 illustrates a further embodiment in accordance with the invention.

FIG. 4 illustrates a further embodiment in which the polymer film 5 extends down over the side wall 18 of the edge support ring 9. A groove 19 is provided in the exterior surface of the side wall 18 of the edge support ring 9 and the polymer film 5 is held within the side groove by an O-ring 20.

Figure 5:
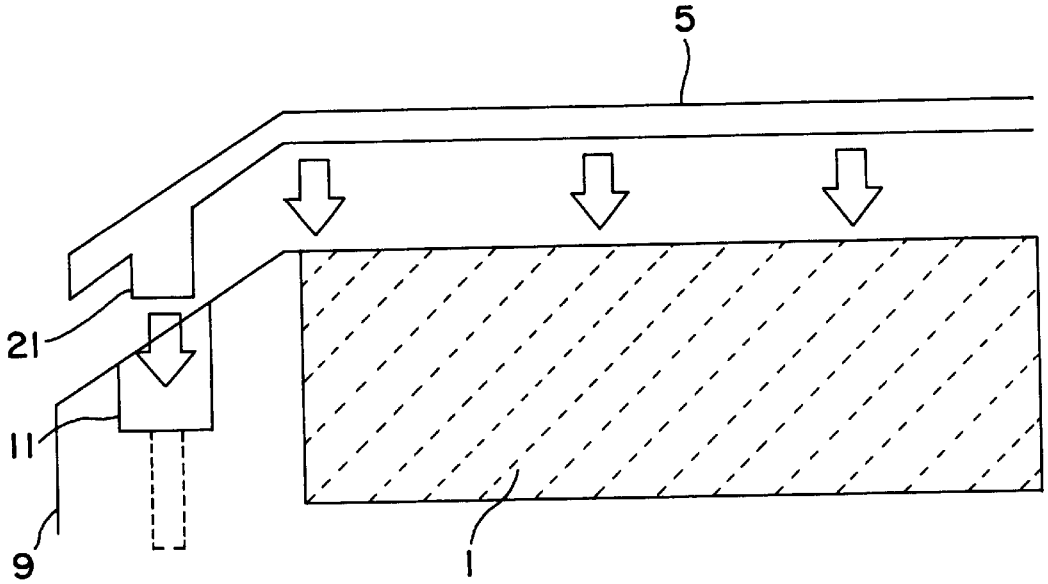
FIG. 5 illustrates a further embodiment in accordance with the invention.

Further, the back of the thin film 5 can be provided with structural features that aid in retaining the film on the lap substrate 1. See, e.g., FIG. 5, in which the top surface of the edge support ring 9 is provided with an annular groove 11. The back of the lap film 5 is provided with a matching annular projection 21. When the lap film 5 is positioned on top of the lap substrate 1, the projection 21 extends into the annular groove 11, thereby aiding in holding the film 5 in place. Here also, the annular groove 11 can be in fluid communication with the vacuum source to thereby facilitate retention of the lap film.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosure of all applications, patents and publications, cited above and below, are hereby incorporated by reference.

EXAMPLES

Example 1

A flat lap substrate having a thickness of 25 mm and a diameter of 75 mm is provided. The lap substrate is made of AmPorOx® fibrous foamed alumina ceramic with an approximate porosity of 80% and average pore size of 2–5 mm. See FIG. 1. The top surface of the lap substrate is ground flat using a Blanchard grinder to provide a large number of separated facets having sizes of typically 2 mm. The back of the lap substrate is then bonded by an adhesive to a metal vacuum back plate having a central hole for connection with a vacuum supply source. The edges of the lap substrate are sealed with electrical tape and the top surface is sprayed with an adhesive (3M Super 77). A 100 mm diameter disk having a thickness of 25 $\mu$m of thermal shrink-wrap film (ATW 501 265) is laid over the top surface of a lap substrate. The edge of the film extends over the edge of the lap substrate and is held thereto via an elastic band. A vacuum is applied via the central hole in the vacuum back plate and a hot air gun is used to temporarily soften the shrink film. The film is held firmly on the facets of the top surface of the lap substrate and slumps slightly into the pores. Application of the heat and vacuum are then terminated and the lap is ready for use with diamond or other abrasives, polishing agents such as colloidal silica or colloidal alumina, or chemo-mechanical media such as chrome oxide. The lap can be used, for example, to polish semiconductors, such as silicon wafers, optical lenses and metal substrates such as computer hard disks made of nickel.

The above example can be repeated using a porous silicon carbide having a thickness of 6 mm and a diameter of 50 mm as the lap substrate.

Example 2

A porous silicon carbide lap substrate with a thickness of 12.5 mm and a diameter of 150 mm is provided. A thin coating of RTV silicone caulk is applied to the edge of the lap substrate. The lap substrate is then positioned within a tapered aluminum edge support ring. The caulk serves to seal the edge of the lap substrate and hold it in place within the support ring. Once the silicone caulk has set, the top surface of the lap substrate is ground flat and levelled with the top of the tapered aluminum edge support ring. The support ring and lap substrate are then connected to a vacuum back plate which is provided with vacuum distribution rings. The vacuum back plate is also provided with a central hole for connection with a vacuum supply source. A polymer lap film made of PTFE having a diameter of 200 mm and a thickness of 75 $\mu$m is a laid on the top surface of the lap substrate. A vacuum is applied to the central vacuum hole whereby the lap film is made to deform to the texture of the top surface of the lap substrate. See FIG. 2. The lap can be used, for example, to polish semiconductors, such as silicon wafers, optical lenses and metal substrates such as computer hard disks made of nickel.

The above example can be repeated using 200 mm diameter films made of polyether ether ketone (75 $\mu$m), shrink-wrap (ATW 501 265) (25 $\mu$m) and aluminum foil (25 $\mu$m) as the lap film.

The above example can be repeated using a tapered PTFE edge support ring and PTFE vacuum back plate.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A lap comprising:

a lap substrate wherein the surface of said lap substrate has an overall shape and a localized texture wherein said localized texture exhibits a plurality of peaks and a plurality of valleys, the peaks of said localized texture providing the overall shape of said lap substrate; and a replaceable lap film applied to the lap substrate surface, said replaceable lap film having a front surface, wherein said replaceable lap film is deformed to exhibit a plurality of deformations which extend into said plurality of valleys, whereby said front surface partially or completely corresponds to said plurality of peaks and said plurality of valleys of said localized texture of said lap substrate surface, wherein said deformations are not induced by contact with a workpiece.

2. A lap according to claim 1, wherein an adhesive layer is provided between said lap substrate and said replaceable lap film to secure said lap film to said lap substrate.

3. A lap according to claim 1, wherein deformation of said replaceable lap film is performed by application of vacuum, pressure, heat, an electrostatic field, a magnetic field or mechanical force.

4. A lap according to claim 3, wherein deformation of said replaceable lap film is performed by application of vacuum.

5. A lap according to claim 1, wherein deformation of said replaceable lap film is performed by application of heat and vacuum.

6. A lap according to claim 1, wherein deformation of said replaceable lap film is performed by application of heat and mechanical force.

7. A lap according to claim 1, wherein said lap substrate is made of metal, porous ceramic, crystalline material, glass-ceramic or glass.

8. A lap according to claim 1, wherein said lap substrate is made of polymeric material or composite material.

9. A lap according to claim 1, wherein said lap substrate is made of foamed silicon carbide, porous silicon carbide, foamed alumina, porous alumina, porous carbon, porous graphite, solid metals, porous metals, crystalline silicon, glass-ceramic, fiber reinforced polymeric material, metal matrix composite or whisker reinforced ceramic.

10. A lap according to claim 1, wherein said replaceable lap film is a polymer film or a thin metal foil.

11. A lap according to claim 1, wherein said replaceable lap film is waxed paper.

12. A lap according to claim 10, wherein said replaceable lap film is made of polyethylene, polyester, polyvinylchloride, polymethylmethacrylate, polyether ether ketone, polytetrafluoroethylene or derivatives thereof.

13. A lap according to claim 1, wherein said replaceable lap film is made of thermally deformable shrink-wrap film.

14. A lap according to claim 1, wherein said replaceable lap film is made of aluminum, lead, zinc or tin.

15. A lap according to claim 1, wherein said replaceable lap film has a thickness of 10 $\mu$m–500 $\mu$m.

16. A lap comprising:

a lap substrate wherein the surface of said lap substrate has an overall shape and a localized texture; and a replaceable lap film applied to the lap substrate surface and which is deformed to partially or completely correspond to said localized texture of said lap substrate surface;

wherein said localized texture is machined or etched into the surface of said lap substrate to define a pattern.

17. A lap according to claim 1, wherein the front surface of said replaceable lap film has a texture of different spatial scale than the localized texture of said lap substrate.

18. A lap according to claim 1, wherein the front surface of said replaceable lap film has abrasives embedded therein.

19. A lap according to claim 1, wherein the deformation of said replaceable lap film produces permanent deformations in said replaceable lap film.

20. A lap according to claim 1, wherein the deformation of said replaceable lap film produces temporary deformations in said replaceable lap film.

21. A lap according to claim 1, wherein said replaceable lap film is applied directly to said lap substrate surface without the use of an intervening adhesive layer.

22. A lap according to claim 15, wherein said replaceable lap film has a thickness of 20–75 $\mu$m.

23. A lap according to claim 1, wherein an adhesive layer is provided between said lap substrate and said replaceable lap film to maintain the deformation of said lap film.

24. A lap according to claim 2, wherein an adhesive layer is provided between said lap substrate and said replaceable lap film to maintain the deformation of said lap film.

25. A lap according to claim 1, wherein deformation is performed by application of chemicals to said lap film.

26. A lap according to claim 1, wherein said localized texture is machined or etched into the surface of said lap substrate to define a pattern.

27. A lap according to claim 1, wherein said replaceable lap film is chemically resistant.

28. A lap according to claim 1, wherein said replaceable lap film is impermeable.

29. A method comprising:

grinding and/or polishing at least one surface of a substrate using at least one lap device, wherein said lap device comprises:

a lap substrate wherein the surface of said lap substrate has an overall shape and a localized texture; and a replaceable lap film applied to said lap substrate surface and which is deformed to correspond to said localized texture of said lap substrate surface;

wherein said lap film is deformed to correspond partially or completely to said localized texture of lap substrate surface prior to said device contacting at least one surface to be ground and/or polished;

wherein deforming of said lap film results in said lap film exhibiting a plurality of deformations and said deformations extend into a plurality of valleys within said localized texture of said lap substrate surface.

30. A method according to claim 29, further comprising applying a deforming force to said lap film continuously during said grinding and/or polishing.

31. A method according to claim 30, wherein said deforming force is vacuum.

32. A method according to claim 31, wherein said vacuum is continuously monitored.

33. A method according to claim 29, wherein said replaceable lap film extends over the edge of said lap substrate and is attached to the side of said lap substrate.

34. A method according to claim 29, wherein said replaceable lap film is deformed by application of vacuum, heat, electrostatic field, magnetic field or combinations thereof.

* * * * *